United States Patent [19]

Rosman

[11] Patent Number: 4,801,126

[45] Date of Patent: Jan. 31, 1989

[54] HYDRAULICALLY OPERATED LIFT MECHANISM

[75] Inventor: Alan H. Rosman, Woodland Hills, Calif.

[73] Assignee: Dynamic Hydraulic Systems, Inc., Canoga Park, Calif.

[21] Appl. No.: 17,588

[22] Filed: Feb. 24, 1987

[51] Int. Cl.[4] ..... B66F 3/24

[52] U.S. Cl. ..... 254/93 R; 254/386

[58] Field of Search ..... 254/93 R, 361, 386, 254/89 H; 91/420; 60/372

[56] References Cited

U.S. PATENT DOCUMENTS

| | | | |
|---|---|---|---|
| 2,897,907 | 8/1959 | Blount et al. | 254/386 |
| 2,994,202 | 8/1961 | Knapp et al. | 254/93 R |
| 4,715,180 | 12/1987 | Rosman | 91/420 |

*Primary Examiner*—Frederick R. Schmidt
*Assistant Examiner*—Judy J. Hartman
*Attorney, Agent, or Firm*—Hopgood, Calimafde, Kalil, Blaustein & Judlowe

[57] ABSTRACT

A three-chamber jack employs a telescoping relation between an outer cylinder and an intermediate cylinder, the closed outer ends of which cylinders continuously sustain lifting-load force. An annular piston is fixed to the inner end of the intermediate cylinder and has sealed sliding engagement to the bore of the outer cylinder. An inner cylinder is fixed to the closed outer and of the outer cylinder and extends concentrically within both the outer and the intermediate cylinder; and the inner cylinder has sealed sliding engagement with the bore of the annular piston. Three internal volumes are thus defined. Load-counterbalancing gas pressure is continuously operative within the first of those volumes, over the entire area of the annular piston, and hydraulic fluid contained within the second and third volumes is reversibly pumped from one to the other of the second and third volumes, to reversibly determine piston displacement.

17 Claims, 2 Drawing Sheets

HYDRAULICALLY OPERATED LIFT MECHANISM

BACKGROUND OF THE INVENTION

The invention relates to a hydraulically operated lift system wherein a hydraulic accumulator is gas-pressurized to provide a counterweight function, thus imposing reduced power requirements on the hydraulic part of the system.

Rosman pending patent application Ser. Nos. 570,590 and 601,481 disclose such systems wherein the accumulator pressurizes a fixed volume of hydraulic fluid which is essentially self-contained at all times in the included volume of (a) the hydraulic end of the accumulator, (b) the actuating end of a lift-operating traction cylinder, and (c) their interconnection, which interconnection includes a so-called power integrator. The accumulator pressure is selected to develop a traction-cylinder force which reflects an average-load condition on the lift system. Pressures on opposite sides of the power integrator are thus equal or nearly equal at all times, and the power integrator is primarily a device for selective transfer of hydraulic fluid from (or to) the accumulator or to (or from) the traction cylinder in any given descent (or lift) displacement of the load. A first pilot-operated check valve in the connection of the integrator to the accumulator, and a second pilot-operated check valve in the connection of the integrator to the traction cylinder, are actuated to open whenever the integrator is called upon to control displacement of hydraulic fluid; and when a given load elevation is to be held, pilot pressures are relieved to allow the respective check valves to maintain the currently shared proportion of hydraulic fluid at the accumulator end and at the actuator end of the system.

A point to be observed with respect to an accumulator-balanced system of the character indicated is that actuated displacement of the traction cylinder must always involve displaced hydraulic fluid which is operative over the entire piston area of the traction cylinder. Thus, for a large traction cylinder displacement, there must be a relatively large volumetric displacement of hydraulic fluid.

BRIEF STATEMENT OF THE INVENTION

It is an object of the invention to provide an improved gas-pressure-balanced hydraulic-lift system wherein a given actuator displacement can be achieved with substantially reduced flows of hydraulic fluid.

Another object is to achieve the above object with substantially reduced power consumption, for a given load and load displacement.

It is also an object to meet the above objects with a hydraulic-lift system which can maintain a given load at a given elevation with little or no power consumption but which is in instantaneous readiness to change the elevation of the load in either direction of displacement, all whether the load is at minimum or maximum for the involved system.

A general object is to achieve the above objects with relatively simple components that are easily maintained.

The invention achieves these objects in a hydraulic-lift system which employs a triple-volume jack involving a telescoping relation between an outer cylinder and an intermediate cylinder, the closed outer ends of which cylinders continuously sustain lifting-load force. An annular piston is fixed to the inner end of the intermediate cylinder and has sealed sliding engagement to the bore of the outer cylinder. An inner cylinder is fixed to the closed outer end of the outer cylinder and extends concentrically within both the outer and the intermediate cylinder, and the inner cylinder has sealed sliding engagement with the bore of the annular piston. Three internal volumes are thus defined: (1) in the annulus defined by and between the inner and outer cylinders, on one side of the piston, (2) in the annulus defined, on the other side of the piston, by and between the intermediate and outer cylinders, and (3) within the intermediate cylinder and within that portion of the inner cylinder which extends through the piston to the fixed end of the inner cylinder. Load-counterbalancing gas pressure is continuously operative within the first of these volumes, over the entire area of the annular piston, and hydraulic fluid contained within the second and third volumes is reversibly pumped from one to the other of the second and third volumes, to reversibly determine piston displacement.

DETAILED DESCRIPTION

Figure 1:
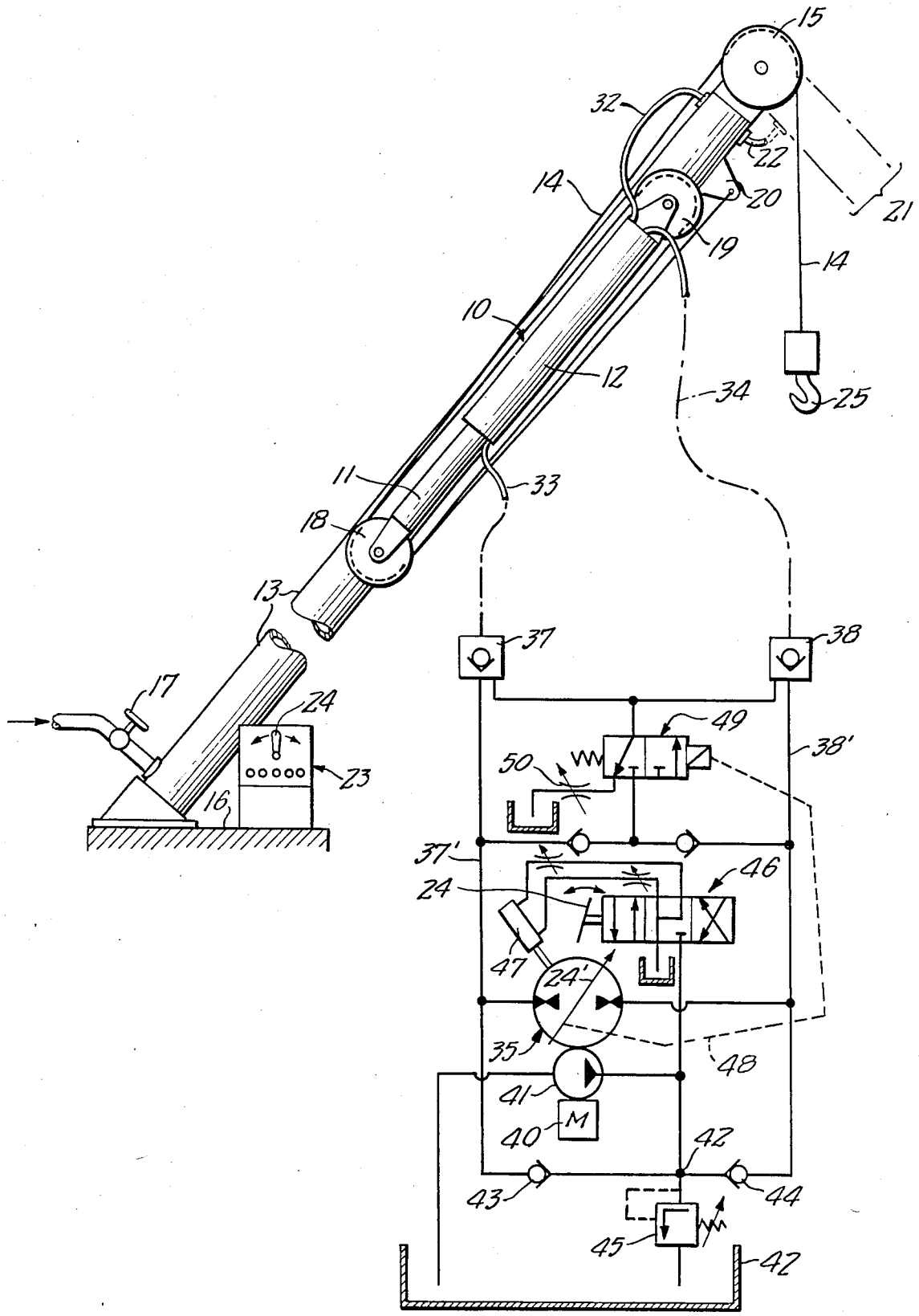
Figure 2:
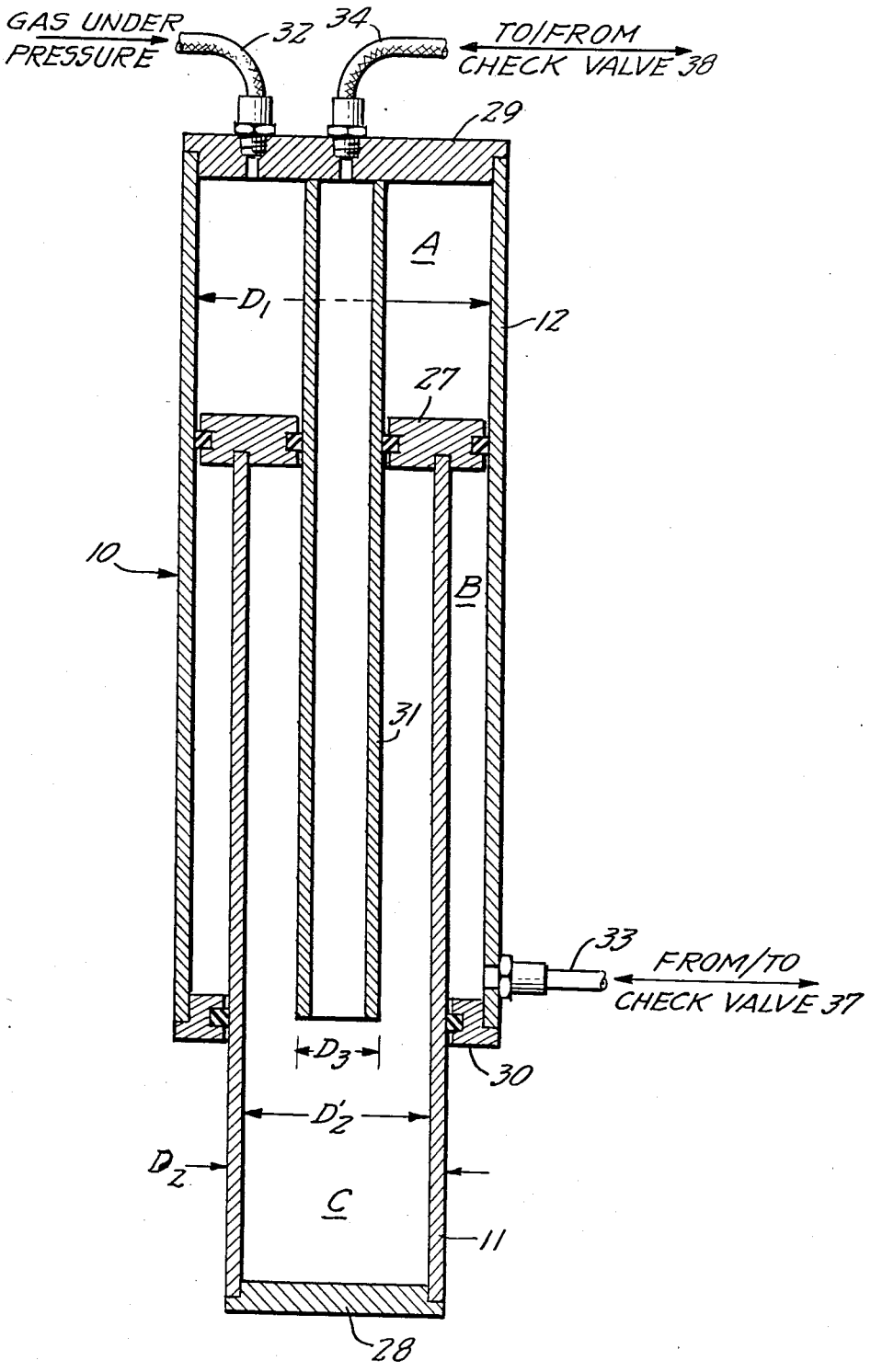

The invention will be described in detail in conjunction accompanying drawings, in which:

FIG. 1 is a simplified view in elevation of a hydraulic-lift system of the invention, with schematic showing of components; and FIG. 2 is an enlarged longitudinal section to illustrate contents of a triple-volume actuator in the system of FIG. 1.

In the lift system of FIG. 1, a triple-volume jacking actuator 10 is seen to include an elongate intermediate cylinder 11 having sealed telescoping engagement within an elongate outer cylinder 12, and cylinder 12 is fixedly mounted to leg or boom structure 13. Structure 13 is shown as an elongate cylinder which will be understood to be closed at its ends and to serve (1) as a container of pressurized gas and (2) as a structural upright for overhead suspension of a hoist cable 14 over an upper sheave 15. The base end of structure 13 is suitably referenced to a footing 16 and means including a valve 17 is operable when filling cylinder 13 to a predetermined level of gas pressure. Sheaves 18–19 are carried at the respective closed outer ends of cylinders 11–12, and cable 14 will be understood to pass around sheaves 18–19, preferably with multiple reaving, to a fixed bracket termination at 20. If structure 13 is a boom, it will have articulating connection in reference to the footing 16, but as shown it is part of a multiple-leg support of the upper sheave 15, another leg of which is suggested at 21. Such additional leg structure 21 will be understood to duplicate structure 13, thus providing additional volume for a stored supply of gas under pressure, in continuous fluid communication with structure 13 via means 22.

A control console 23 at the footing 16 includes a manually operable handle 24 for up/down control of such loads as are to be hoisted via suspension from the hook (25) end of cable 14. Circuitry and components at or within console 23 are schematically shown in FIG. 1 but will be described following more specific identification of the parts of jacking actuator 10, in conjunction with FIG. 2.

In FIG. 2, the intermediate cylinder 11 is seen to be fixed at its inner end to an annular piston 27 having sealed sliding coaction with the bore of outer cylinder 12. Welded end bells 28–29 close the respective outer ends of cylinders 11–12 (the end closure 29 being sometimes referred to as the head-end closure of outer cylinder 12), and welded annular closure 30 at the other or tail end of the outer cylinder 12 provides sealed slidable support of the outer cantilevered end of intermediate cylinder 11. The bore diameter of outer cylinder 12 is designated $D_l$, and the outer diameter of intermediate cylinder 11 is designated $D_2$. Finally, a third (inner) cylinder 31, of outer diameter $D_3$, is concentrically fixed to the end bell 29 and extends with sealed sliding engagement to and through the bore of piston 27 with its open end communicating with the inner volume of the intermediate cylinder 11.

The described structure of FIG. 2 thus defines three volumes which are utilized for counterbalancing and control purposes of the invention. The first of these volumes is identified A and is an annulus charged with gas pressure via connection 32 to the charged interior of leg structure 13. Gas pressure in volume A is always operative over the full annular area of piston 27, urging piston 27 in the direction opposed to the gravitational force of load (at hook 25) upon cable 14; preferably, the volumetric capacity for storage of pressurized gas in structure 13 is at least ten times the maximum volume displaceable at A by reason of a full stroke of piston 27. On the other side of piston 27, a second volume B is an annulus filled (via a line 33) with hydraulic fluid, being defined by and between the bore diameter $D_l$ of the outer cylinder 12 and the outer diameter $D_2$ of the intermediate cylinder 11; any force or displacement attributable to hydraulic pressure in volume B is operative only over a relatively small fraction of the total area of piston 27, and such force is in partial opposition to the counterbalance force of gas pressure in volume A. The third volume C contains hydraulic fluid (supplied via line 34) within intermediate cylinder 11 and within that part of inner cylinder 31 which extends between piston 27 and end bell 29; the annular section area between diameter $D_3$ and the bore diameter $D_2'$ of intermediate cylinder 11 is common to both of the fixed ends of cylinder 11, so that any force or displacement attributable to hydraulic pressure in volume C is operative only over a relatively small circular area (of diameter $D_3$), i.e., effectively the section area subtended by the bore of piston 27—and such force is additive to the counterbalance force of gas pressure in volume A. Suitably and preferably, the circular area at diameter $D_3$ is equal or nearly equal to the annular section area of the volume B.

Returning to FIG. 1, control circuitry for the described actuator 10 connects the respective ports of a variable-flow reversible pump 35 to a different one of the lines 33–34 so that, depending upon the flow direction called for by manipulation of handle 24, hydraulic fluid will be displaced from volume C (or B) to volume B (or C); such connections are via pilot-operated check valves 37–38, each of which is preferably of the so-called barrier type. Pump 35 thus has series-connecting lines 37'–38' to lines 33–34 via the respective pilot-operated check valves. Pump 35 is suitably of the axial-piston variety, having a swash plate 24' which is tilted to one or the other side of a neutral position, depending upon the desired direction of flow; pump 35 is continuously driven by diesel, electric motor or other prime-mover means 40 which also drives a high-pressure, low-capacity pump 41 whereby pilot-operating pressure can always be available when needed. As shown, pump 41 draws hydraulic fluid from a sump 42 and can provide the pilot-operating pressure, when needed, via connection 42 and back-to-back check valves 43–44 to the respective lines 37'–38'; to the extent not needed, the pressure fluid to connection 42 is returned to sump via a relief valve 45.

As shown, manipulation of handle 24 determines which of three positions will be selected for the spool of a servo valve 46 having control connections to the respective ends of a double-acting actuator 47 for positioning the tilt aspect of the swash plate of pump 35. In the mid-position or neutral condition of valve 46, pressure fluid supplied by pump 41 is cut off, and the swash plate of pump 35 will be understood to be urged by return-spring means (not shown) into neutral position, as permitted by orifice settings which determine the rate at which the swash plate will be permitted to return to its neutral position, with drainage to sump from one or the other end of actuator 47. A shift of handle 24 in one direction determines one direction of pressure-fluid supply to actuator 47 and therefore one direction of swash-plate tilt, and a shift in the opposite direction similarly determines the opposite direction of swash-plate tilt.

Dashed lines 48 will be understood to suggest means whereby any actuation of handle 24 away from neutral position will automatically actuate a solenoid valve 49 from its normally closed condition (shown) to its open condition. In open condition, hydraulic pressure of fluid drawn by pump 41 is supplied to actuate the pilots of valves 37–38, thus placing the reversible displacement pump 35 in open communication with actuator volumes B and C. If the direction of handle-24 displacement is such as to move hydraulic fluid from volume B (via lines 33–34) to volume C, actuator 10 will spread sheaves 18–19 and thus lift hook 25 and its load; and if handle 24 is displaced the other side of neutral, hydraulic fluid will be displaced from volume C to volume B, for a controlled descent of hook 25 and its load. Upon re-centering the handle back to its neutral position, the solenoid of valve 49 will be de-energized, allowing valve 49 to return to its "normal" position (shown), wherein pilot-operating fluid is vented to sump at a rate governed by an orifice 50; this allows both check valves 37–38 to close, thus holding whatever may be the currently elevated position of hook 25 and its load. It should be noted that the venting of pilot-operated fluid upon return of valve 49 to its normal position involves only miniscule discharge to sump; lines 37'–38', pump 35 and all other parts of the control system remain filled with hydraulic fluid, even if the prime mover 40 is shut down. In normal load-manipulating operations, the prime mover 40 runs continuously, so that pump 41 maintains the hydraulic control connections at pilot-operating pressure, in instant readiness for an opening actuation of the pilot-operated valves 37–38 as soon as valve 49 is actuated upon displacement of handle 24 away from its neutral position.

It will be recalled that the gas pressure supplied to volume A by the charged volume of cylinder 13 is advisedly selected to enable piston 27 to counterbalance an average load upon lift cable 14. If a given load is above this average, then to hold a given elevation of the load, the closed condition of check valve 38 will lock the then-existing volume of hydraulic fluid in line 34 and in volume C as a firm clamp on the elevated condition of the load. On the other hand, if a given load is below average, the closed condition of check valve 37 will lock the then-existing volume of hydraulic fluid in line 33 and in volume B as a firm clamp on the elevated condition of the load. It will be noted that in the above-average load condition, the hydraulic fluid trapped by closure of check valve 38 is under compression, to the extent reflecting the amount by which the given load exceeds average load (sustained by pressurized gas in volume A); and in the below-average load condition, it is the hydraulic fluid trapped by closure of check valve 37 that is under compression, to the extent reflecting the amount by which the given load is less than average load. Thus, pressure in line 33 or in line 34 will always be a function of the amount by which a given load differs from average, and when control handle 24 is moved to cause a given direction of load displacement, pump 35 will effect its appropriately directional shuttling displacement of hydraulic fluid from one to the other of volumes B and C under such pressure as is needed to add to or subtract from the counterbalance force of the pressurized gas in volume A.

The described three-chamber actuator and associated pressurized-gas accumulator and control system will be seen to meet all stated objects, and to be applicable in a wide variety of lifting situations. In all cases, it s a particular feature that the volume of hydraulic fluid which must be displaced to achieve a given lift or descent manipulation of a load is relatively small, in that the area of hydraulic-fluid action, whether via volume B or volume C is always a relatively small fraction of the annular area (at 27) over which pressurized-gas counterweight action is operative. The following tabulation of basic dimensions is illustrative of non-buckling actuator structures and capacities, for different sizes of suitably machined, commercially available steel tubing.

| Example | No. 1 | No. 2 | No. 3 | No. 4 | No. 5 | No. 6 |
|---|---|---|---|---|---|---|
| Diameter $D_1$ (inches) | 10.00 | 12.00 | 15.00 | 18.00 | 20.00 | 24.00 |
| Diameter $D_2$ (inches) | 8.00 | 10.00 | 12.00 | 15.00 | 16.00 | 20.00 |
| Diameter $D_3$ | 6.00 | 6.50 | 9.00 | 10.00 | 12.00 | 14.00 |
| Counter-weight-Thrust Area at 27 ($in^2$) | 50.27 | 79.91 | 113.10 | 175.93 | 201.06 | 298.45 |
| Acting Area of Volume B ($in^2$) | 28.27 | 34.56 | 63.62 | 77.75 | 113.10 | 138.23 |
| Acting Area of Volume C ($in^2$) | 28.27 | 33.18 | 63.62 | 78.54 | 113.10 | 153.94 |
| Thickness of cylinder 12 (in) | 0.60 | 0.72 | 0.90 | 1.08 | 1.20 | 1.44 |
| Thickness of cylinder 11 (in) | 0.80 | 1.00 | 1.20 | 1.50 | 1.60 | 2.00 |
| Pushing Capacity (Tons): --(i) 1500 psi constant gas pressure, and 2500 psi max. oil pressure | 73.04 | 101.41 | 164.34 | 230.12 | 292.17 | 416.26 |
| --(ii) 1000 60.48 psi constant gas pressure, and 2500 psi max. oil pressure | 81.44 | 136.07 | 186.14 | 241.90 | 341.65 | |

In general, it may be observed that whatever the size and capacity of a given lift system of the present invention, the amount of hydraulic fluid to be displaced, in order to achieve a given load displacement, is approximately one third of the hydraulic displacement involved in the above-identified Rosman hydraulic-lift patent applications. And essentially the same savings in installed power capacity (i.e., at prime mover 40) are realized as in the systems of said patent applications, i.e., in both cases as compared to conventional hydraulic-lift systems, which have no gas-pressurized accumulator.

While the invention has been described in detail for illustrative embodiments, it will be understood that modifications may be made without departing from the scope of the invention. For example, when a particular application of the invention contemplates a first load range which varies under first conditions, say ±25 tons from an average of 75 tons, the gas pressure in structure 13 may be selected to achieve the counterweight equivalent of 75 tons; and where the same application contemplates a second load range which varies under second conditions, say ±25 tons from an average of 100 tons, the gas pressure in structure 21 may be selected to achieve the counterweight equivalent of 100 tons, it being understood that in place of the connection 22 between structures 13 and 21, suitable selectively operable valving (not shown) will enable a selected one of the gas accumulators 13–21 to be in communication with volume A, as appropriate to the currently applicable load range.

What is claimed is:

1. In a hydraulically operated lift system, a three-volume cylindrical actuator, comprising an outer elongate tubular cylindrical actuator, comprising an outer elongate tubular cylinder of bore diameter $D_1$, said cylinder extending between a head end and a tail end, an annular piston having a head side and a tail side and having sealed slidable engagement to the bore of said outer cylinder, an intermediate elongate tubular cylinder of outer diameter $D_2$ less than $D_1$ and concentrically fixed at one end to the tail side of said piston, said intermediate cylinder being closed at its other end, head-closure means closing the head end of said outer cylinder, an inner elongate tubular cylinder (1) of outer diameter $D_3$ substantially less than the bore diameter of said intermediate cylinder and (2) concentrically fixed at one end to said head-closure means and (3) extending with sealed slidable engagement within and beyond the bore of said piston, said inner cylinder being open at its other end within said intermediate cylinder, annular tail-closure means closing the tail end of said outer cylinder with sealed slidable engagement to said intermediate cylinder; thereby defining a first annular volume radially between said inner and outer cylinders and axially between said piston and said head-closure means, a second annular volume radially between said intermediate and outer cylinders and axially between said piston and said tail-closure means, and a third volume within said inner and intermediate cylinders; the sectional area of said second volume being substantially equal to the sectional area of said inner cylinder; first connection means including an accumulator for supplying fluid under substantially uniform preloading pressure to said first volume essentially independent of the axial position of said piston within said outer cylinder, whereby both said second and third volumes can be preloaded via preloading pressure fluid in said first volume, second connection means for a first hydraulic line to said second volume, and third connection means for a second hydraulic line to said third volume; a closed hydraulic system comprising a reversible hydraulic pump connected to and interposed between said first and second lines for selectively and reversibly transferring hydraulic-fluid between said second and third volumes; and externally exposed means on said outer and intermediate cylinders for compressionally sustaining a lifting load.

2. The lift system of claim I, in which said externally exposed means includes sheave means mounted to the closed end of said intermediate cylinder.

3. The lift system of claim 2, in which said last-defined means further includes sheave means mounted to the first-closure end of said outer cylinder.

4. The lift system of claim 1, in which a first pilot-operated check valve is in said first line and a second pilot-operated check valve is in said second line, said check valves being oriented to check flow in the direction toward said pump, a prime mover for said pump, and control means including pilot-operating pressure connections to said check valves and responsive to rotation of said prime mover.

5. The lift system of claim 4, in which said pump includes a tiltable swash plate for determining the magnitude and direction of pumped flow for tilt positions on opposite sides of a neutral no-flow position.

6. The lift system of claim 4, in which said prime mover is a diesel engine.

7. The lift system of claim 4, in which said prime mover is an electric motor.

8. The lift system of claim 5, in which said control means includes a manually operable hydraulic servo system for tilt control of said swash plate, said servo system having a neutral position determining zero tilt of said swash plate, and venting means correlated to the zero-tilt condition of said swash plate for venting pilot-operating pressure from said check valves.

9. The lift system of claim 4, in which said pilot-operated valves are of the barrier variety.

10. The lift system of claim 1, wherein the capacity of the system is for a rated load which comprises a fixed dead-load component and a live-load component of unestablished magnitude, and in which the pressure of preloading fluid supplied from said accumulator to said first volume is preselected to balance said lift system with equal hydraulic pressure in both said lines where the live-load component is at a preselected level intermediate a zero live-load condition and a maximum live-load condition.

11. The lift system of claim 10, in which said intermediate level is at substantially one half said maximum.

12. The lift system of claim 8, in which said pilot-operating pressure connections include a pair of back-to-back connected check valves respectively connected to the line connections of said pump, and oriented to provide a source of pilot-operating pressure at their back-to-back interconnection, said venting means being a control valve operatively interposed between said interconnection and the pilots of said pilot-operated check valves.

13. The lift system of claim 1, in which a first pilot-operated check valve is in said first line and a second pilot-operated valve is in said second line, said check valves being oriented to check flow in the direction toward said pump, and control means including a prime mover for said pump and a prime-mover-driven connection adapted to actuate the pilots of said check valves.

14. The lift system of claim 1, in which said accumulator has a substantially greater volumetric capacity for containment of pressurized gas than the combined capacity of said second and third volumes.

15. The lift system of claim 14, in which said accumulator means includes at least one elongate tubular structural member of the lift system, said outer cylinder being carried by said at least one structural member.

16. The lift system of claim 3, in which multiple reeving spans both said sheave means.

17. The lift system of claim 14, in which said accumulator has a volumetric capacity which is at least ten times the combined capacity of said second and third volumes.

* * * * *